US005079978A

United States Patent [19]

Kupfer

[11] Patent Number: 5,079,978

[45] Date of Patent: Jan. 14, 1992

[54] DOUBLE-CODED WRENCHES AND SOCKETS

[76] Inventor: William Kupfer, P.O. Box 613, Sumter, S.C. 29151

[21] Appl. No.: 598,840

[22] Filed: Oct. 16, 1990

Related U.S. Application Data

[63] Continuation-in-part of Ser. No. 385,969, Jul. 27, 1989, abandoned.

[51] Int. Cl.[5] ..... B25B 13/02

[52] U.S. Cl. ..... 81/119; 81/121.1; 81/DIG. 5; 206/376

[58] Field of Search ..... 81/119, 121.1, 124.3, 81/124.6, 124.7, DIG. 5; 206/372, 373, 376-378; 220/22

[56] References Cited

U.S. PATENT DOCUMENTS

| | | | |
|---|---|---|---|
| 2,161,163 | 2/1939 | Hedgpeth | 81/DIG. 5 X |
| 4,100,824 | 7/1978 | Marschise | 81/124.6 |
| 4,380,293 | 4/1983 | Wilcox et al. | 206/378 X |
| 4,795,180 | 1/1989 | Polcyn | 206/373 X |
| 4,982,627 | 1/1991 | Johnson | 81/121.1 |
| 5,031,488 | 7/1991 | Zumeta | 81/180.1 |

FOREIGN PATENT DOCUMENTS

| | | | |
|---|---|---|---|
| 2424585 | 12/1975 | Fed. Rep. of Germany | 81/DIG. 5 |

OTHER PUBLICATIONS

"Tools & Shop Supplies", Continental Heavy Duty Socket Sets, Combination SAE & Metric; p. 150; 1979.

*Primary Examiner*—James G. Smith
*Attorney, Agent, or Firm*—Bailey & Hardaway

[57] ABSTRACT

A novel combination of two sets of wrenches and sockets, each identifiable for size, with each set calibrated according to a different measuring system and both housed in a common container, and a novel process for identifying said size and said measuring systems by indicia specific to each size and to each system of measurement.

1 Claim, 4 Drawing Sheets

DOUBLE-CODED WRENCHES AND SOCKETS

CROSS REFERENCE TO RELATED REFERENCES

This application is a continuation-in-part of application Ser. No. 07/385,969 filed July 27, 1989 now abandoned.

BACKGROUND OF THE INVENTION

This invention relates generally to the art of mechanics and more particularly to the art of sized wrenches and sockets and involves identification of the various sizes and the two measuring systems in which hand tools are calibrated by recognizing indicia appearing on the tools which correspond to various sizes and to one measuring system or the other.

Various techniques exist within the prior art to readily distinguish one tool or part thereof from another. One such technique is disclosed in German Patent Application No. 24 23 686 which suggests the use of red paint or a particular shaping on the more commonly used size of a tool having two sizes.

The Jensen Fall Catalog dated September 1977 shows a variety of hand tools having handles of different colors to facilitate usage.

Whereas the prior art provides techniques of distinguishing one hand tool or part thereof from another, the development of the novel apparatus and process herein described are significant to the field and noteworthy in accordance with their distinguishing features. Included among the features is an identification system making the various sizes of the sockets and wrenches easily recognizable by touch or sight. Also, the identification of the measuring system in which a tool is calibrated by the recognition of indicia specific to the particular system and the provision of tools of both metric and English measuring systems to be housed together in one container.

SUMMARY OF THE INVENTION

It is thus an object of this invention to provide a novel combination of two sets of wrenches and sockets, each set calibrated according to a different measuring system and both housed in a common container.

It is a further object of this invention to provide a novel process for identifying tools according to the various sizes and the measuring system in which they are calibrated, by the recognition of indicia specific to each system.

These as well as other objects are accomplished by a mechanical apparatus comprising a conventional set of wrenches and sockets calibrated in the metric system and a conventional set of wrenches and sockets calibrated in the English system, one set distinguishable from the other by differing indicia discernible by sight or touch. Further, each of the wrenches and sockets in both sets bears differing indicia indicating the various sizes, and the two sets of wrenches and sockets are housed in a common carrier.

DETAILED DESCRIPTION OF THE DRAWINGS

Figure 1A:
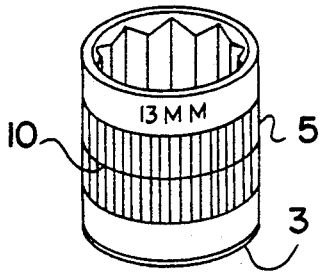
FIG. 1 of the drawings is a perspective view of sample wrenches and sockets each calibrated in the metric system which is identifiable by color in accordance with this invention and identifiable for size by the use of grooves in accordance with this invention.
Figure 1B:
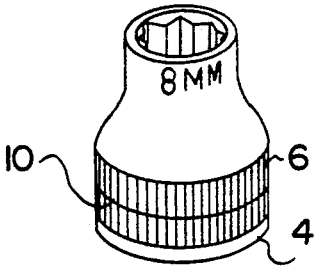
Figure 1C:
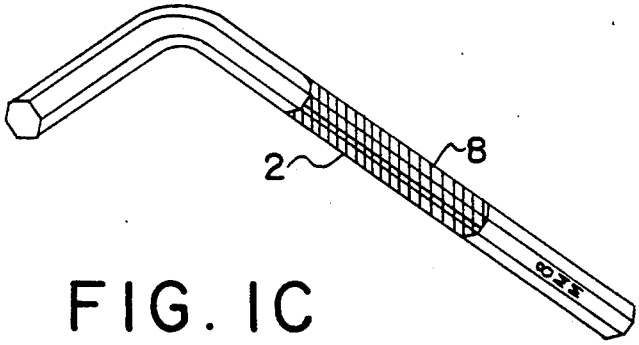
Figure 1D:
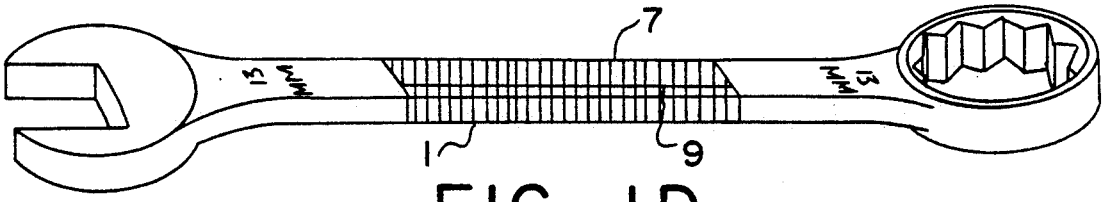
Figure 2A:
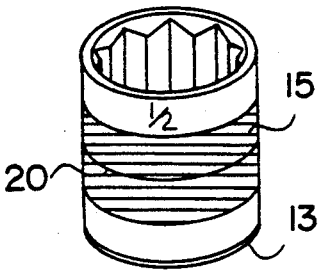
FIG. 2 is a perspective view of sample wrenches and sockets each calibrated in the English system which is identifiable by color and for size in accordance with this invention.
Figure 2B:
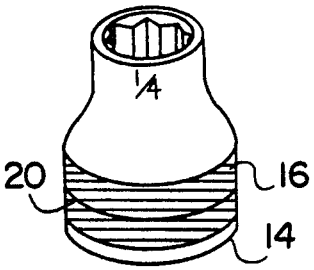
Figure 2C:
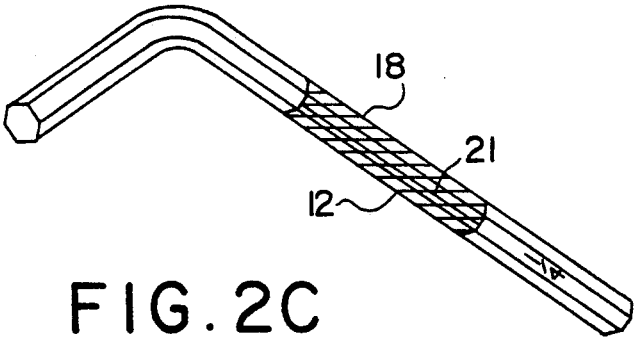
Figure 2D:
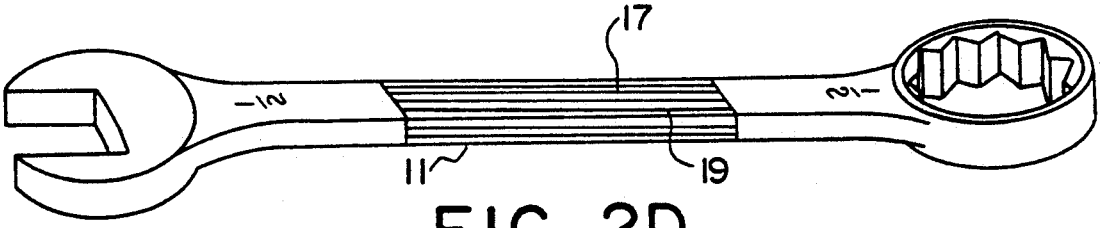

In accordance with this invention, it has been found that hand tools may be enhanced in various ways to readily identify the size and particular measuring system in which they are calibrated. The enhancement may be visible or it may be distinguishable by touch. The latter is particularly applicable in situations in which there is no ample lighting or in the case of a person with impaired vision. Whether the enhancement is visible or tactile, the selection time of the required tool is reduced and usage is facilitated.

In one preferred form of the invention, the enhancement for the tools is in the form of colored vinyl. In another preferred form of the invention, the enhancement is in the form of swaging patterns. In addition, a common container for two sets of hand tools calibrated in different systems and marked according to sizes is particularly convenient to the user. The container provides for display and rapid identification of the size and the required measuring system and allows easy access to individual tools. Further advantages will become apparent from the following description given with reference to the various figures of drawings.

FIG. 1 of the drawings illustrates sample wrenches 1 and 2 and sample sockets 3 and 4, each from a conventional set of wrenches and sockets and each calibrated in the metric system as shown.

The wrenches bear a size identification system comprised of lengthwise grooves 9 on the wrenches, with one groove on the smallest wrench and each size larger wrench progressively bearing one more groove such that the largest wrench bears the greatest number of grooves.

The sockets also bear a size identification system comprised of grooves along the grasping surfaces 10. Such sockets exist in groups of three sockets of similar length and diameter. Within each group of three, each socket is distinguishable from the others by the smallest socket in the group bearing one groove around its surface, the next largest socket bearing two grooves, and the largest socket in the group bearing three grooves.

As illustrated in FIG. 1, the system of measurement of these tools is identified by sight by a particular color on the grasping surfaces 5, 6, 7 and 8, which also distinguishes them as a group from similar tools calibrated in the English system of measurement, as seen in FIG. 2.

FIG. 2 of the drawings illustrates sample wrenches 11 and 12 and sample sockets 13 and 14, each from a conventional set of wrenches and sockets and each calibrated in the English system as indicated. Again, the size of each wrench and socket in relation to the others is identifiable by the grooves on the grasping surfaces 19, 20 and 21, which is discernible by sight or touch.

The system of measurement of these tools is identified by sight by a particular color on the grasping surfaces 15, 16, 17 and 18. Such color is chosen to be different from the color identifying the set of tools calibrated in the metric system so as to differentiate between the sets.

Figure 3A:
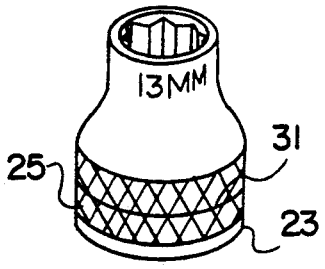
FIG. 3 of the drawings is a perspective view of a sample wrench and a sample socket, each identifiable for size and each calibrated in the metric system which is identifiable by swaging pattern in accordance with this invention.
Figure 3B:
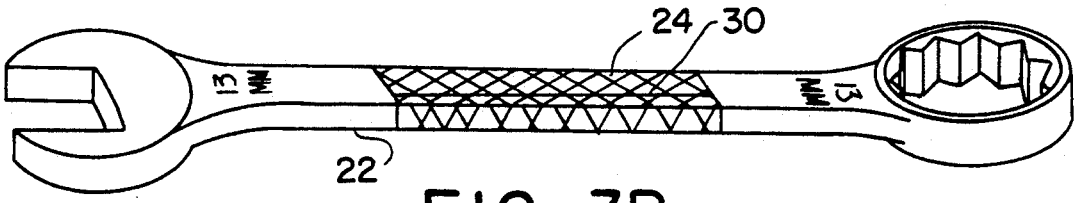
Figure 4A:
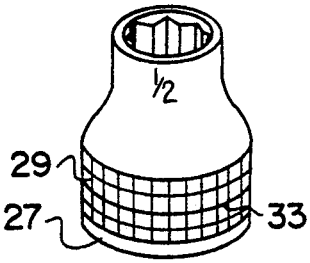
FIG. 4 is a perspective view of a sample wrench and a sample socket, each identifiable for size and each calibrated in the English system which is identifiable by swaging pattern in accordance with this invention.
Figure 4B:
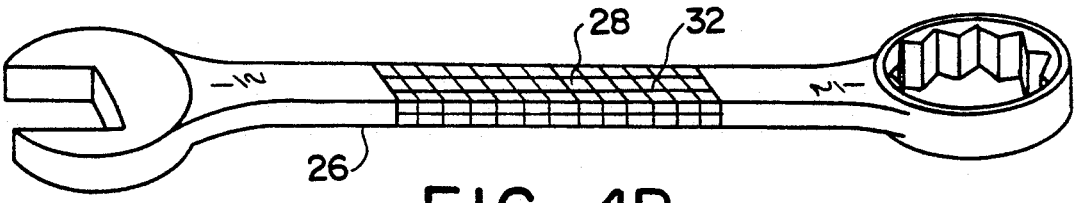

In FIGS. 3 and 4 of the drawings, a second means of identifying different systems of measurement for hand tools is illustrated. Again, the size of each wrench 22, 26 and each socket 23, 27 is identifiable by the grooves 30, 31, 32 and 33 on respective tools 22, 23, 26 and 27 which are discernible by sight or touch. Sample wrench 22 and sample socket 23, each from a conventional set of wrenches and sockets, are enhanced along their grasping surfaces 24 and 26 by a swaging pattern which identifies by touch these tools as being calibrated in the metric system, as shown, and distinguishes them from tools calibrated in the English system, as seen in FIG. 4.

FIG. 4 of the drawings illustrates sample wrench 26 and sample socket 27 each from a conventional set of wrenches and sockets which are enhanced along their grasping surfaces 28 and 29 by a swaging pattern which identifies by touch these tools as being calibrated in the English system, as shown. The swaging pattern is chosen to be different from the swaging pattern identifying the set of tools calibrated in the metric system so as to distinguish between the two sets.

Figure 5:
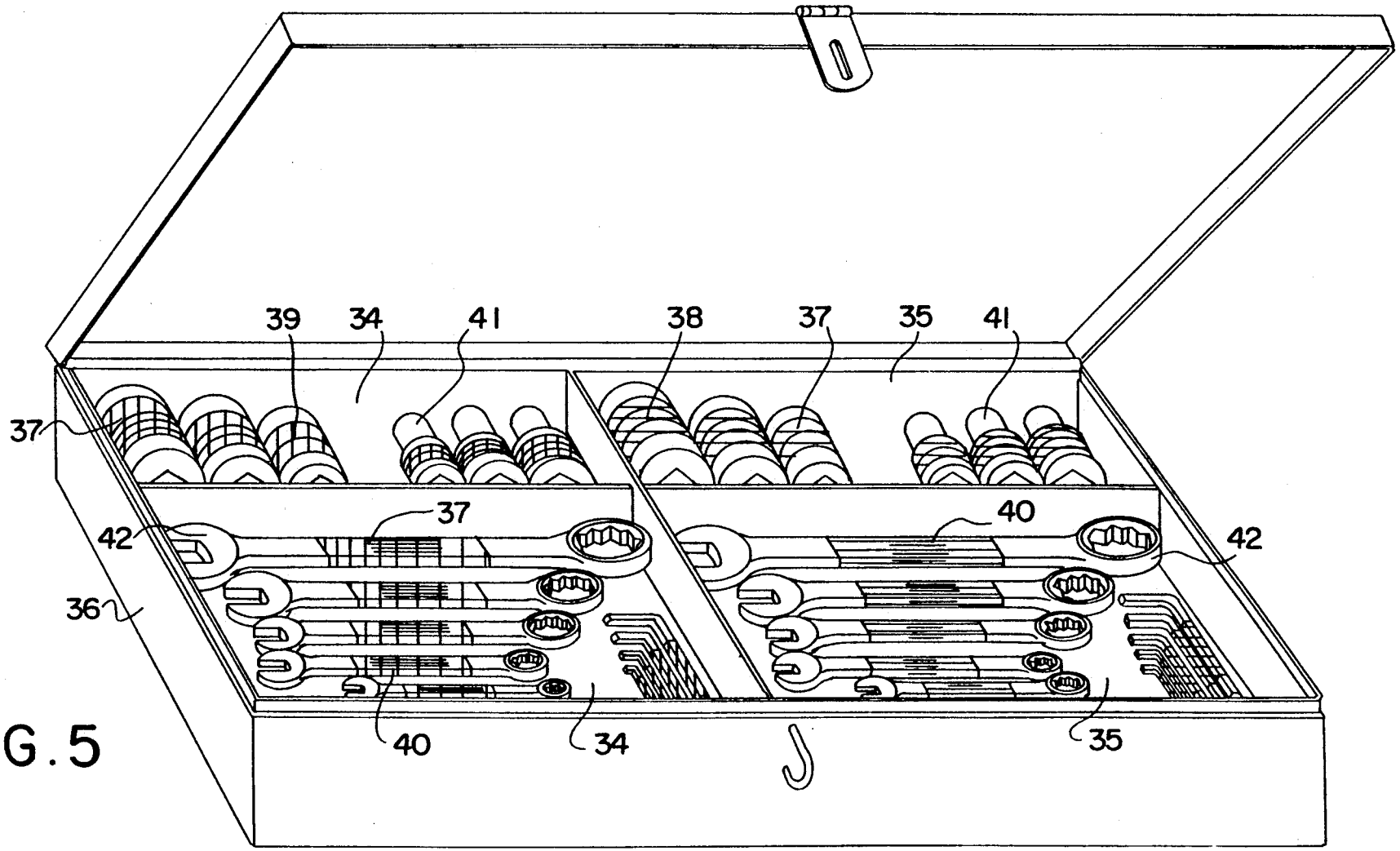
FIG. 5 of the drawings is a perspective view of a set of hand tools identifiable for size and calibrated in the metric system and a set of hand tools calibrated in the English system housed in a common container.

FIG. 5 of the drawings illustrates the set of hand tools 34 identifiable by size and calibrated in the metric system and the set of similar hand tools 35 also identifiable by size and calibrated in the English system housed in the common container 36. Each socket 41 bears an indicia 37 identifying it to a particular system of measurement. Each socket 41 also bears a size identification system comprised of grooves along the grasping surfaces 38, 39. The sockets 41 exist in groups of three of similar length and diameter. Within each group of three, each socket 41 is distinguishable from the others by the smallest socket in the group bearing one groove around its surface, the next largest socket bearing two grooves, and the largest socket in the group bearing three grooves, as seen in each set of hand tools 34 and 35.

Each wrench 42 also bears an indicia 37 identifying it to a particular system of measurement and bears a size identification system comprised of lengthwise grooves along the grasping surfaces 40, with one groove on the smallest wrench and each size larger wrench progressively bearing one more groove such that the largest wrench bears the greatest number of grooves, as seen in each set of hand tools 34 and 35.

It is thus seen that this invention provides a novel combination of two conventional sets of wrenches and sockets housed in a common container. It is further seen that this invention provides means of distinguishing the sets of tools from each other, according to the various sizes and according to the measuring system used for each, by indicia discernible by sight or touch. As variations of the apparatus of this invention will be apparent to one of skill in the art from a reading of the above specifications, such variations are within the spirit and scope of this invention as defined by the following appended claims.

What is claimed is:

1. A tool set comprising:

a container with dividers therein defining four separate compartments;

said compartments to house two sets of wrenches and two sets of sockets;

a first set of wrenches calibrated in the metric system, said first set distinguished by a first indicia common to each member of said first set and being discernible by sight or touch;

a first set of sockets in a second of said compartments calibrated in the metric system all having said first indicia thereon;

a second set of wrenches calibrated in the English system in a third compartment, said second set distinguished by a second indicia common to each member thereof and being discernible by sight or touch and differing from said first set of indicia;

a second set of sockets calibrated in the English system bearing said second indicia;

said first and second sets of wrenches being further distinguished by an identification system comprised of lengthwise grooves on said wrenches, with the smallest wrench bearing one groove and each size larger wrench progressively bearing one more groove such that the largest wrench bears the greatest number of grooves, thereby making each wrench discernible by sight or touch from the other wrenches;

said first and second sets of sockets being comprised of various groups of three sockets of similar diameter and similar length wherein the smallest diameter socket bears one groove, the socket with the next largest diameter bears two grooves, and the largest diameter socket of the group bearing three grooves, thereby making all three sockets within the groups of three discernible by sight or touch and differing from the other sockets within the group;

a closure for said container.

* * * * *